US007324049B2

(12) United States Patent
Myoung et al.

(10) Patent No.: US 7,324,049 B2
(45) Date of Patent: Jan. 29, 2008

(54) MINIATURIZED ULTRA-WIDEBAND MICROSTRIP ANTENNA

(75) Inventors: Soung-ho Myoung, Hanam-si (KR); Do-Hoon Kwon, Seoul (KR); Seong-soo Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 188 days.

(21) Appl. No.: 11/024,715

(22) Filed: Dec. 30, 2004

(65) Prior Publication Data

US 2005/0156787 A1 Jul. 21, 2005

(30) Foreign Application Priority Data

Jan. 5, 2004 (KR) ..... 10-2004-0000384

(51) Int. Cl.
*H01Q 1/38* (2006.01)

(52) U.S. Cl. ..... 343/700 MS; 343/846

(58) Field of Classification Search ..... 343/700 MS, 343/702, 833, 834, 846, 790, 792
See application file for complete search history.

(56) References Cited

U.S. PATENT DOCUMENTS

| | | | | |
|---|---|---|---|---|
| 5,828,340 | A * | 10/1998 | Johnson | 343/700 MS |
| 6,392,599 | B1 * | 5/2002 | Ganeshmoorthy et al. | 343/700 MS |
| 6,747,600 | B2 * | 6/2004 | Wong et al. | 343/700 MS |
| 6,828,939 | B2 * | 12/2004 | Li | 343/700 MS |
| 6,861,990 | B2 * | 3/2005 | Hung et al. | 343/702 |
| 7,042,403 | B2 * | 5/2006 | Colburn et al. | 343/702 |
| 2003/0210187 | A1 | 11/2003 | Wong et al. | 343/700 |
| 2004/0017315 | A1 | 1/2004 | Fang et al. | 343/700 |
| 2004/0233110 | A1 | 11/2004 | Hung et al. | 343/700 |

FOREIGN PATENT DOCUMENTS

| | | |
|---|---|---|
| GB | 2150356 | 6/1985 |
| JP | 06-052215 | 7/1994 |
| JP | 11-261308 | 9/1999 |
| JP | 11-340728 | 12/1999 |

(Continued)

OTHER PUBLICATIONS

Jen-Yea Jan et al., "Planar Monopole Antennas For 2.4/5.2 Ghz Dual-Band Application," IEEE Antennas and Propagation Society Int'l Symposium, 2003 Digest, Jun. 22-27, New York, NY, 2003, pp. 158-161, vol. 4, IEEE.

(Continued)

*Primary Examiner*—Tho Phan
(74) *Attorney, Agent, or Firm*—Staas & Halsey LLP

(57) ABSTRACT

A miniaturized ultra-wideband microstrip antenna, includes: a dielectric substrate; a feed line disposed on the dielectric substrate, and supplying an electromagnetic energy supplied from an external power source; a main radiating element radiating the electromagnetic energy inputted by the feed line; and at least one sub-radiating element disposed in proximity to the main radiating element for multi-radiation. Also, the antenna further includes at least one connection plate electrically connecting the main radiating element to at least one of the sub-radiating elements. The miniaturized ultra-wideband microstrip antenna can also be made ultralight, and include additional sub-radiating elements besides the main radiating element, whereby multi-radiation in UWB's range can be attained.

45 Claims, 11 Drawing Sheets

FOREIGN PATENT DOCUMENTS

| | | |
|---|---|---|
| JP | 2001-326528 | 11/2001 |
| JP | 2001-358527 | 12/2001 |
| JP | 2002-9533 | 1/2002 |
| JP | 2003-51708 | 2/2003 |
| JP | 2003-347837 | 12/2003 |
| KR | 2000-0075673 | 12/2000 |
| TW | 541762 | 7/2003 |
| TW | 558078 | 10/2003 |
| WO | WO 01/45204 | 6/2001 |

OTHER PUBLICATIONS

Jeemyung Lee et al., "Design Of Ceramic Chip Antenna For Bluetooth Applications Using Meander Lines," IEEE Antennas and Propagation Society Int'l Symposium, 2002 Digest, San Antonio, TX, Jun. 16-21, 2002, pp. 68-71, vol. 1, IEEE.

Coulibaly, Y. et al., "A New Single Layer Broadband CPW-fed Printed Monopole Antenna for Wireless Applications," Canadian Conf. On Electrical and Computer Engineering, Piscataway, NJ, May 2-5, 2004, pp. 1541-1544, vol. 13, IEEE.

Chung K. et al., "Wideband CPW-fed Monopole Antenna with Parasitic Elements and Slots," Electronics Letters, Great Britain, Aug. 19, 2004, pp. 1038-1040, vol. 40, No. 17, IEE.

* cited by examiner

MINIATURIZED ULTRA-WIDEBAND MICROSTRIP ANTENNA

CROSS-REFERENCE TO RELATED APPLICATION

This application claims the benefit under 35 U.S.C. § 119 from Korean Patent Application No. 2004-00384, filed on Jan. 5, 2004 in the Korean Intellectual Property Office, the disclosure of which is incorporated herein by reference.

BACKGROUND OF THE INVENTION

1. Field of the Invention

The present invention relates in general to a wideband impulse transmitting/receiving antenna for use with communication systems employing electromagnetic impulses, such as, UWB (Ultra Wideband) communications. More specifically, the present invention relates to a miniaturized UWB microstrip antenna having excellent wideband characteristics by changing the notch structure of a main radiating element and a sub-radiating element connected to the main radiating element.

2. Description of the Related Art

UWB uses pulses which have the attribute of being spread over a frequency range measured in 3.1-10.6 gigahertz (GHz) for transmitting digital data as far as 10 m-1 km.

As already known, impulse radio communications, unlike existing narrowband communications, use an ultra-wideband frequency band and transmit high-speed data consuming much power. To commercialize the impulse radio communication system for a mobile communication terminal, however, a small-sized antenna has to be used.

A related art UWB antenna for transmitting/receiving impulses mainly has been used for radar feed, so its important features of radiating pattern are high power, wide bandwidth, high gain, and low sidelobe. In effect, there were few studies being done on impulse antennas for use with personal mobile communication terminals.

The following will explain related art wideband antennas.

FIG. 1 illustrates an ultra-wideband antenna disclosed in U.S. Pat. No. 5,428,364. This type of antenna requires an impedance taper featuring wide bandwidth impedance matching, in order to secure desired radiation patterns over every range of frequencies and to transmit electromagnetic energy inputted from a source without loss. Also, a slot line impedance taper is used in a matching circuit for wideband matching, so the size of the antenna has to be increased in proportion to a usable frequency range.

FIG. 2 illustrates a single-layer wideband antenna using a stub, disclosed in Korean Pat. No. 2002-73660. For this type of antenna, an open or short stub is attached to a radiating patch to overcome weakness of an existing patch antenna, and as a result, excellent wideband impedance matching characteristics and wideband characteristics are obtained. However, the antenna could not accommodate the UWB waveform, and the patch antenna, being a single patch antenna by nature, is incapable of realizing omni-directional characteristics of antennas. In addition, when mounted in small-sized mobile communication equipment, the antenna's directivity interferes with smooth and proper communication, and thus, at least two antennas are required.

FIG. 3 illustrates a print dipole antenna with wideband characteristics by constructing a matching circuit with more than one open stub on a microstrip line, disclosed in Japanese Pat. No. 5-3726. The print dipole antenna has the matching circuit on a signal line, so it occupies more space than necessary when designing an antenna combined with the dielectric substrate. It is practically impossible to implement a wideband matching circuit having a bandwidth greater than 3:1 in a relatively low (less than 5 GHz) frequency domain. Also, the disclosed antenna has a dual plane structure and thus, process cost thereof is higher than a single plane antenna.

FIG. 4 illustrates an antenna disclosed in Europe Pat. No. WO 02/13313 A2. According to the disclosure, a large planar conductive plate and a small planer conductive plate inserted into an oval-shaped slot are formed in the large element. The suggested antenna size is 2.72×1.83 cm including a radiating slot, which is 8 times bigger than the antenna size of an embodiment of the present invention.

FIG. 5 illustrates an antenna disclosed in U.S. Pat. No. 6,351,246 B1, titled "Planer ultra wide band antenna with integrated electronics". According to the disclosed antenna, a difference signal is applied feed points, and a resistor is situated between a pair of radiating balance elements to improve voltage standing wave ratio (VSWR) of low frequency. Although this type of antenna has electric elements to meet the requirements of pulse communications in a desired frequency range, it is not proper to be miniaturized. Thus, the practicability of the antenna is basically limited. Moreover, because the resistor is employed in order to improve the VSWR in a low frequency range, it is not easy to maintain high reliability of the antenna.

SUMMARY OF THE INVENTION

It is, therefore, an aspect of the present invention to provide a miniaturized ultra-wideband (UWB) microstrip antenna combined with a substrate for use in personal and military mobile communication terminals for high-speed impulse radio communications.

It is another aspect of the present invention to provide a miniaturized UWB microstrip antenna having improved narrowband and multi-harmonic features, by employing a main radiating element and a sub-radiating element connected to the main radiating element.

It is still another aspect of the present invention to provide a miniaturized UWB microstrip antenna with improved wideband-matching properties in a desired frequency range through a specific notch structure constructed of a main radiating element and a sub-radiating element connected thereto.

Yet another aspect of the present invention is to provide a miniaturized UWB microstrip antenna, capable of wideband impedance matching between an antenna and sky wave, by completely irradiating electric impulses on the interface.

To achieve the above and/or aspects and advantages, there is provided a miniaturized ultra-wideband microstrip antenna, including: a dielectric substrate; a feed line disposed on the dielectric substrate, and supplying an electromagnetic energy supplied from an external power source; a main radiating element for radiating the electromagnetic energy inputted by the feed line; and at least one sub-radiating element disposed in proximity to the main radiating element for multi-radiation.

According to an aspect of the present invention, the antenna further includes at least one connection plate for electrically connecting the main radiating element to at least one of the sub-radiating elements.

According to another aspect of the present invention, an upper end of the main radiating element has a rectangular shape, the sub-radiating elements are symmetrically arranged with respect to the main radiating element, and an upper end of each sub-radiating element preferably has a rectangular shape among other possible shapes in order to reduce the size of the antenna.

According to another aspect of the present invention, the length of a long side of the sub-radiating element is smaller than or equal to the length of a long side of the main radiating element.

According to another aspect of the present invention, the feed line includes at least one slot of a predetermined size through an etching process.

According to another aspect of the present invention, one lower side of the main radiating element and the connection plate form a 90° angle, and the connection plate and one lower side of the sub-radiating element form a 90° angle.

According to another aspect of the present invention, one lower side of the main radiating element and the connection plate form a 90° angle, and the connection plate and one lower side of the sub-radiating element form a $(90°+\theta_1)$ angle, where $\theta_1$ is a predetermined angle.

According to another aspect of the present invention, one lower side of the main radiating element and the connection plate form a $(90°+\theta_2)$ angle (where $\theta_2$ is a predetermined angle), and the connection plate and one lower side of the sub-radiating element form a 90° angle.

According to another aspect of the present invention, one lower side of the main radiating element and the connection plate form a $(90°+\theta_3)$ angle, and the connection plate and one lower side of the sub-radiating element form a $(90°+\theta_4)$ angle, where, $\theta_3$ and $\theta_4$ are predetermined angles.

According to another aspect of the present invention, the main radiating element and the sub-radiating elements are disposed on the same planar surface.

According to another aspect of the present invention, the main radiating element and the sub-radiating elements are disposed on a different planar surface.

According to another aspect of the present invention, the main radiating element and the sub-radiating elements are indirectly connected to each other through an electromagnetic coupling, and are spaced apart by a predetermined distance.

According to another aspect of the present invention, the dielectric substrate is an epoxy laminate (FR-4) substrate of which relative dielectric constant ($\epsilon_r$) is approximately 4.4.

According to an aspect of the present invention, the length of a long side of the main radiating element is approximately 11.5 mm.

According to an aspect of the present invention, the length of a long side of the feed line is approximately 55 mm.

According to an aspect of the present invention, the sum of the length of a short side of the main radiating element, the length of the connection plate, and the length of a short side of the sub-radiating element is approximately 6.272 mm.

According to an aspect of the present invention, the connection plates are formed on the upper end, center, or lower end of the main and sub-radiating elements.

According to an aspect of the present invention, the antenna further includes a plurality of ground plates disposed on the top of the dielectric substrate, each being symmetrically spaced apart by a predetermined distance with respect to the feed line.

According to an aspect of the present invention, the antenna further includes a ground plate having a predetermined size to be disposed at the bottom of the dielectric substrate.

According to an aspect of the present invention, the antenna further includes a ground plate having a predetermined size to be disposed at the bottom of the dielectric substrate.

According to an aspect of the present invention, an insertion loss in a frequency range from 3.0 GHz to 12 GHz is less than 10 dB.

According to an aspect of the present invention, VSWR in a frequency range from 3.0 GHz to 12 GHz is less than 2.0.

According to an aspect of the present invention, if the center frequency is 5 GHz, the current is mainly induced to the lower end of the main radiating element.

According to an aspect of the present invention, if the center frequency is 10 GHz, the current is mainly induced to the main radiating element, and a certain part of the sub-radiating element.

According to an aspect of the present invention, also, if the center frequency is 10 GHz, the current is mainly induced to the main radiating element, the connection plate, and a certain part of the sub-radiating element.

According to an aspect of the present invention, the antenna further includes at least one additional sub-radiating element disposed at a predetermined position improving wideband characteristics of the antenna.

According to another aspect of the present invention, VSWR in a frequency range from 3.0 GHz to 18 GHz is less than 2.0.

According to another aspect of the present invention, the antenna further includes a plurality of connection plates for electrically connecting the main radiating element, the sub-radiating elements, and the additional sub-radiating elements to each other.

According to another aspect of the present invention, the antenna further includes at least one connection plate electrically connecting the main radiating element to the additional sub-radiating elements.

According to another aspect of the present invention, the antenna further includes at least one connection plate electrically connecting the sub-radiating elements to the additional sub-radiating elements.

According to another aspect of the present invention, the additional sub-radiating elements are disposed on the same planar surface with the main radiating element or with the sub-radiating elements.

According to another aspect of the present invention, the additional sub-radiating elements are disposed on the same planar surface with the main radiating element and the sub-radiating elements.

According to another aspect of the present invention, the antenna further includes at least one additional sub-radiating element disposed at a predetermined position improving wideband characteristics of the antenna.

According to another aspect of the present invention, the sub-radiating elements and the additional sub-radiating elements are indirectly connected to each other through an electromagnetic coupling, and are spaced apart by a predetermined distance.

According to another aspect of the present invention, the antenna further includes at least one connection plate electrically connecting the sub-radiating elements to the additional sub-radiating elements.

According to another aspect of the present invention, the additional sub-radiating elements are disposed on the same planar surface with the main radiating element or with the sub-radiating elements.

According to another aspect of the present invention, the additional sub-radiating elements are disposed on the same planar surface with the main radiating element and the sub-radiating elements.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following description of the embodiments of the present invention with reference to the accompanying drawings, of which.

DETAILED DESCRIPTION OF THE EMBODIMENTS

Figure 1:
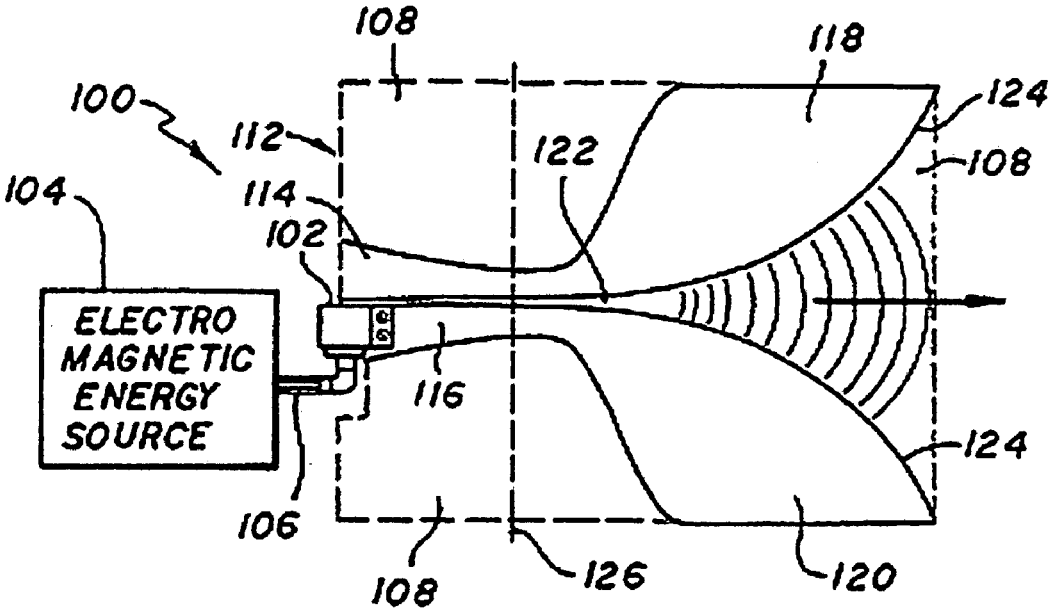
FIG. 1 (PRIOR ART)
FIG. 1 illustrates an ultra-wideband antenna disclosed in U.S. Pat. No. 5,428,364.
Figure 2:
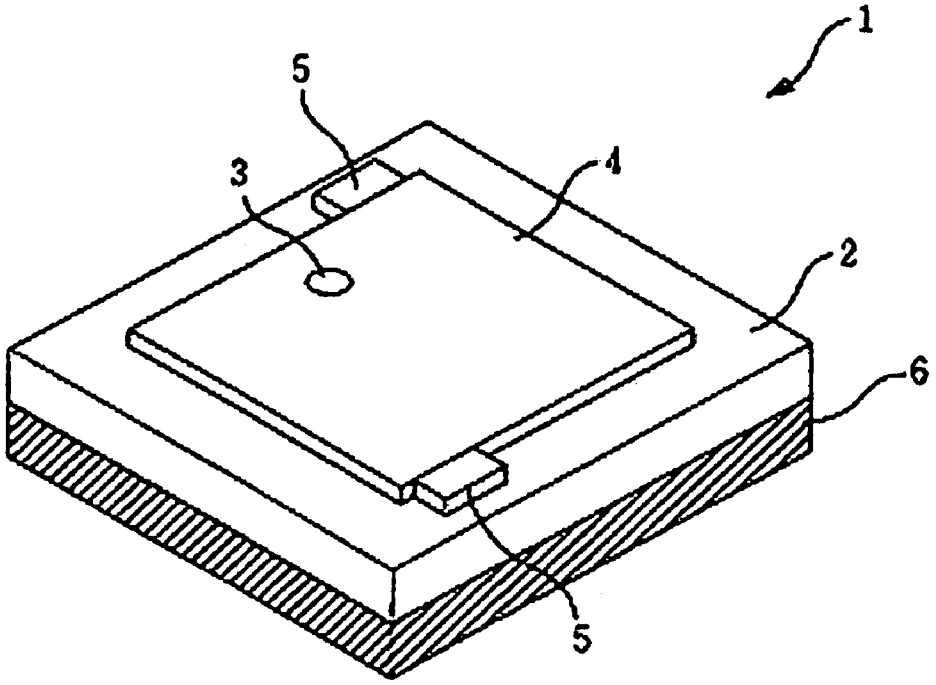
FIG. 2 (PRIOR ART)
FIG. 2 illustrates a single-layer wideband antenna using a stub, disclosed in Korean Pat. No. 2002-73660.
Figure 3:
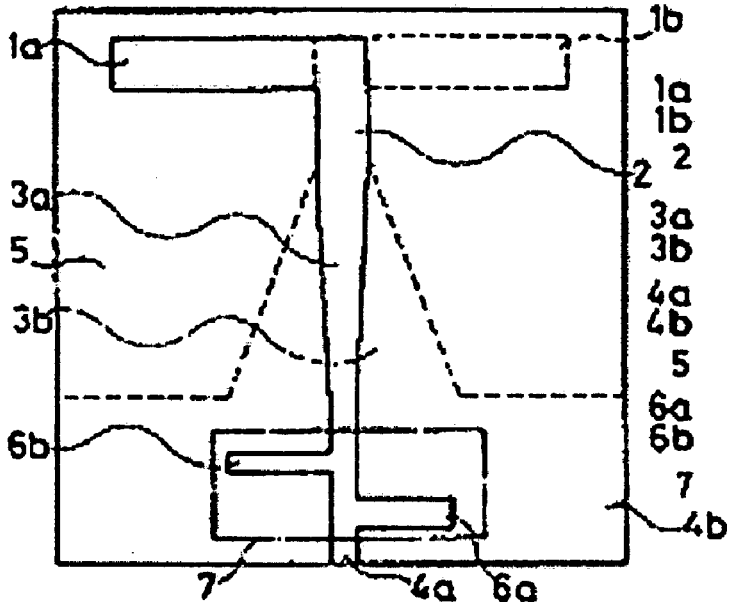
FIG. 3 (PRIOR ART)
FIG. 3 illustrates a print dipole antenna with wideband characteristics by constructing a matching circuit with more than one open stub on a microstrip line, disclosed in Japanese Pat. No. 5-3726.
Figure 4:
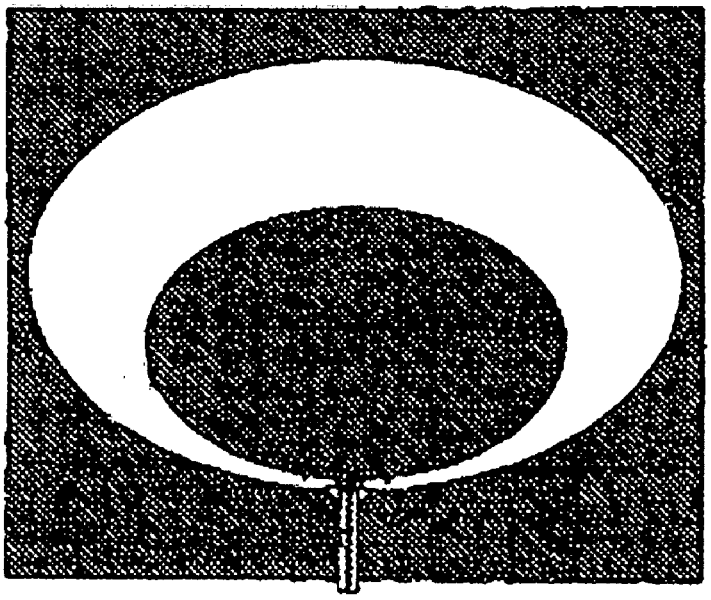
FIG. 4 (PRIOR ART)
FIG. 4 illustrates an antenna disclosed in Europe Pat. No. WO 02/13313 A2.
Figure 5:
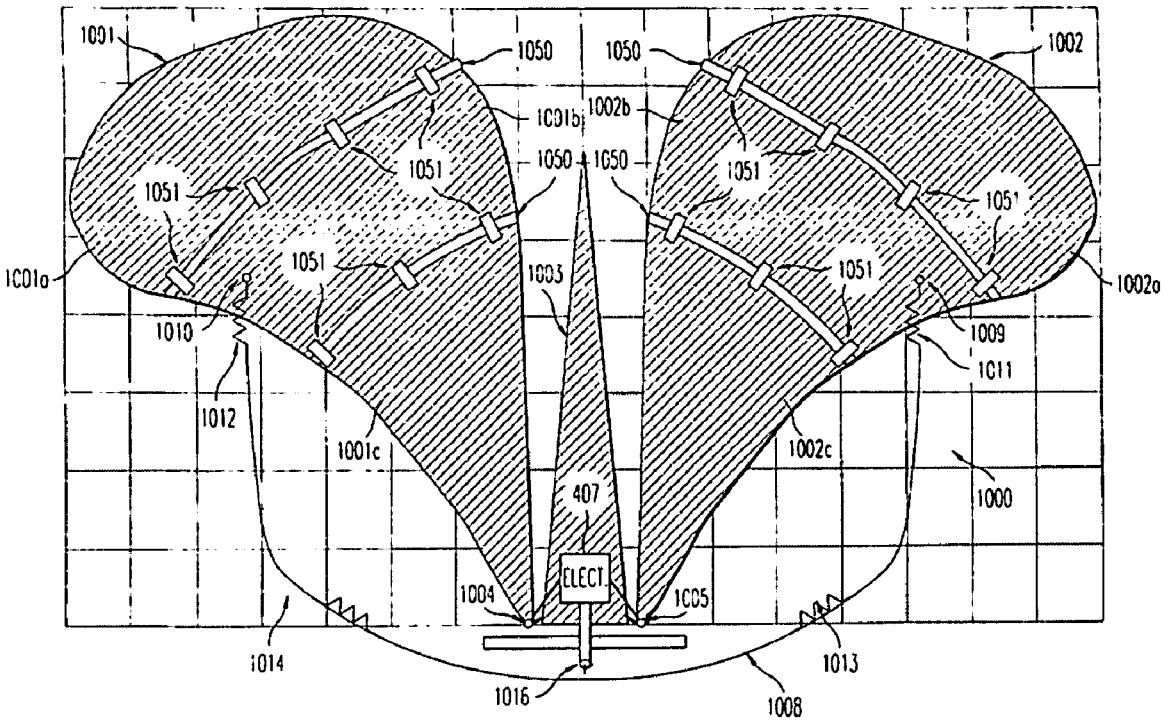
FIG. 5 (PRIOR ART)
FIG. 5 illustrates an antenna disclosed in U.S. Pat. No. 6,351,246 B1, titled "Planer ultra wide band antenna with integrated electronics;"

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 6:
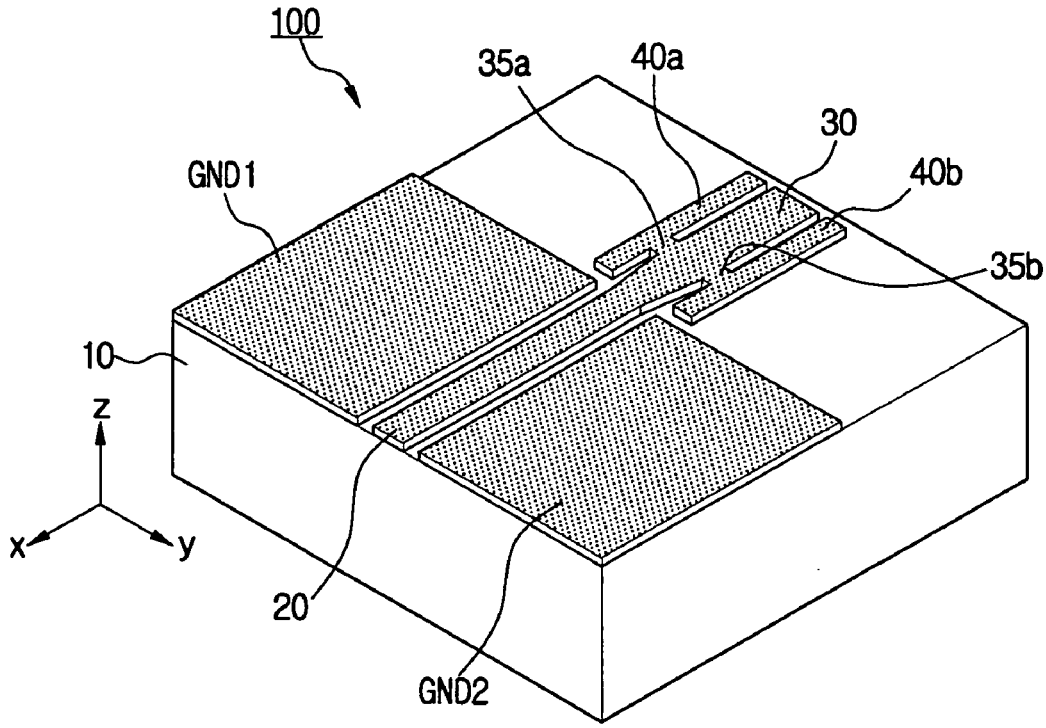
FIG. 6 is a perspective view of a CPW (Coplanar waveguide) fed microstrip antenna according to an aspect of the present invention.
Figure 7:
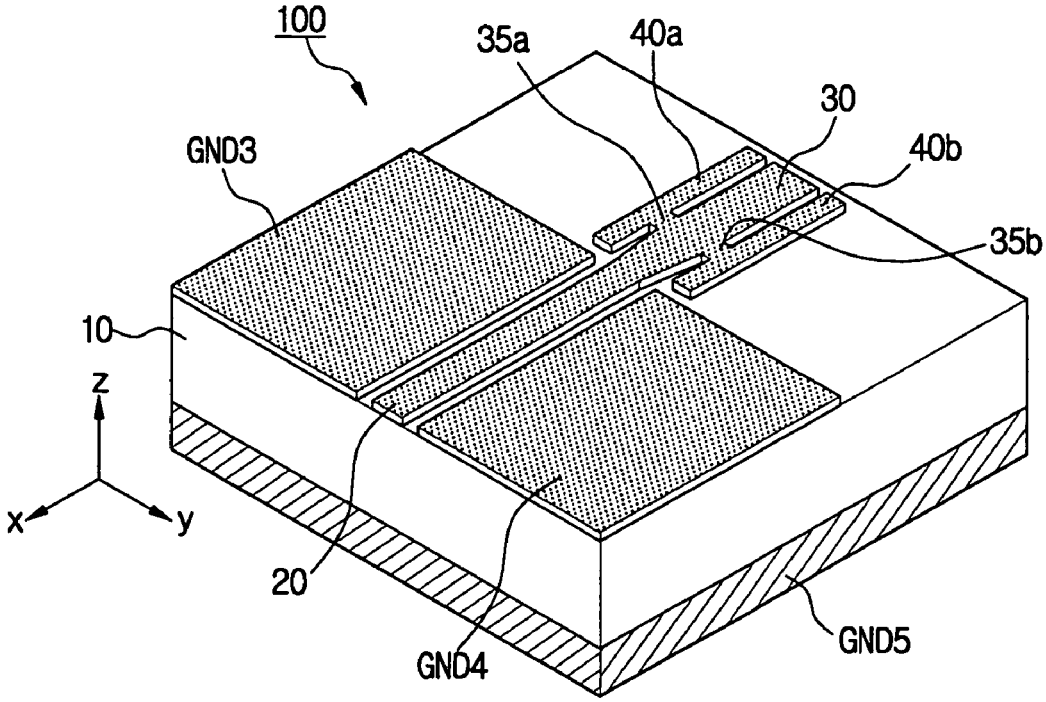
FIG. 7 is a perspective view of a GCPW (Ground coplanar waveguide) fed microstrip antenna according to an aspect of the present invention.
Figure 8:
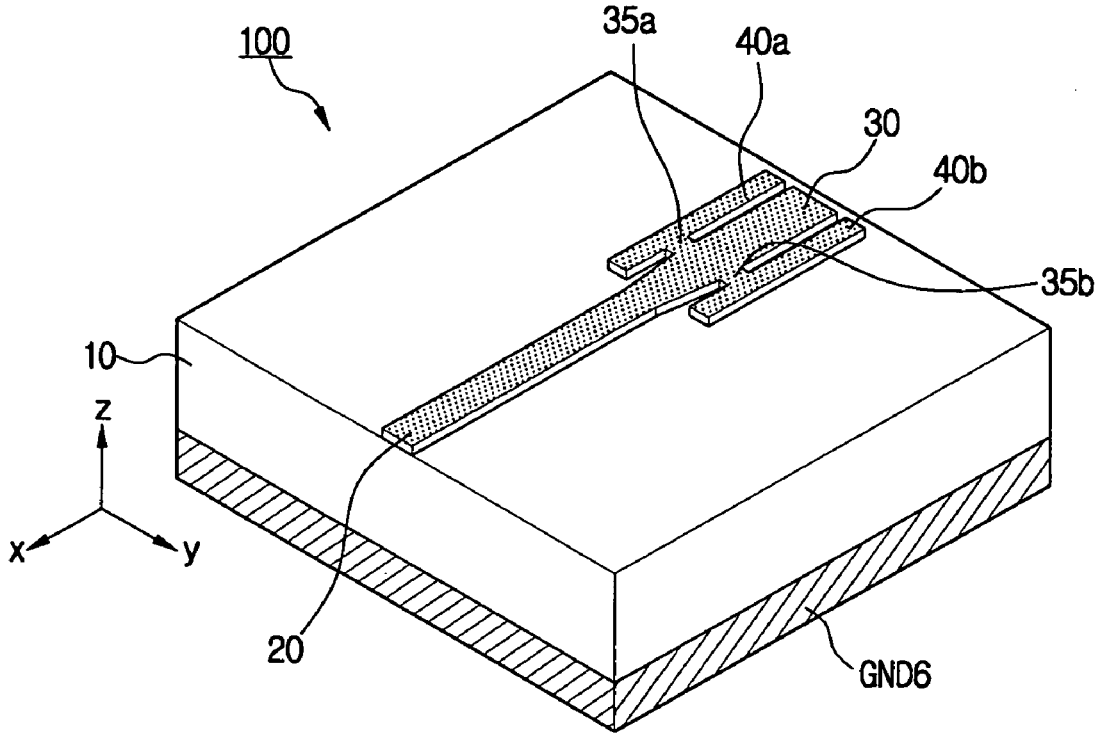
FIG. 8 is a perspective view of a microstrip fed antenna according to an aspect of the present invention.

FIG. 6 is a perspective view of a CPW (Coplanar waveguide) fed microstrip antenna according to an aspect of the present invention; FIG. 7 is a perspective view of a GCPW (Ground coplanar waveguide) fed microstrip antenna according to another aspect of the present invention; and FIG. 8 is a perspective view of a microstrip fed antenna according to another aspect of the present invention As shown in FIGS. 6 to 8, the miniaturized ultra-wideband microstrip antenna 100 of the present invention includes a dielectric substrate 10, a feed line 20, a main radiating element 30, a plurality of connection plates 35*a*, 35*b*, a plurality of sub-radiating elements 40*a*, 40*b*, and ground plates GND1-GND6. In the interest of brevity and convenience, the dielectric substrate 10, the feed line 20, the main radiating element 30, the connection plates 35*a*, 35*b*, and the sub-radiating elements 40*a*, 40*b* are represented by like reference numerals throughout FIGS. 6 to 8.

Preferably, but not necessarily, the feed line 20, the main radiating element 30, the connection plates 35*a*, 35*b*, and the sub-radiating elements 40*a*, 40*b* are conductors, and more preferably, but not necessarily, each is plated with tin against corrosion.

Referring to the CPW fed microstrip antenna shown in FIG. 6, the main radiating element 30, the connection plates 35*a*, 35*b*, the sub-radiating elements 40*a*, 40*b*, the feed line 20, and the first, and second ground plates GND1, GND2 conductively coat the top planar surface of the dielectric substrate 10.

A typically used coating method is the PCB (Printed Circuit Board) process. Preferably, but not necessarily, an epoxy laminate (FR-4) substrate whose relative dielectric constant ($\epsilon_r$) is approximately 4.4 is used for the dielectric substrate 10.

Referring now to FIG. 7, the GCPW fed microstrip antenna, unlike the CPW fed microstrip antenna, is constructed in such a manner that a fifth ground plate GND5 is disposed at the bottom, and the dielectric substrate 10 is layered on the fifth ground plate GND5.

Except for the above, the GCPW fed microstrip antenna and the CPW fed microstrip antenna have the same construction, that is, the main radiating element 30, the connection plates 35*a*, 35*b*, the sub-radiating elements 40*a*, 40*b*, third and fourth ground plates GND3, GND4, and the feed line 20 conductively coat the top planar surface of the dielectric substrate 10.

Referring to the microstrip fed antenna shown in FIG. 8, a sixth ground plate GND6 is disposed at the bottom, and the dielectric substrate 10 is layered on the top of the sixth ground plate GND6. In contrast with the CPW fed microstrip antenna or the GCPW fed microstrip antenna, there is no ground plate formed on the dielectric substrate, but the main radiating element 30, the connection plates 35*a*, 35*b*, the sub-radiating elements 40*a*, 40*b*, and the feed line 20 conductively coat the top of the dielectric substrate 10.

In FIGS. 6 to 8, the connection plates 35*a*, 35*b* electrically connect the main radiating element 30 with the sub-radiating elements 40*a*, 40*b*. However, when the radiating elements are connected indirectly to each other through electromagnetic coupling, the main radiating element 30 and the sub-radiating elements 40*a*, 40*b* are naturally spaced apart. If this is the case, the connection plates 35*a*, 35*b* are unnecessary.

Although FIGS. 6 to 8 illustrate an embodiment where the main radiating element 30 and the sub-radiating elements

40*a*, 40*b* are disposed on the same planar surface, this is illustrative only. That is, the main radiating element 30 and the sub-radiating elements 40*a*, 40*b* can be disposed on different planar surfaces. In this case, the main radiating element 30 and the sub-radiating elements 40*a*, 40*b* are indirectly connected to each other, or can be connected directly to each other via hole (not shown).

According to an embodiment of the invention shown in FIGS. 6 to 8, the top end of the feed line 20 is etched to form a slot (not shown) of a predetermined size. Preferably, but not necessarily, the slots come in various shapes. When etched to form the slot, the feed line functions as a matching circuit for impedance matching. The feed line can be fed with a coaxial cable, and a center conductor (not shown) of the coaxial cable is connected directly to a lower end of the main radiating element 30 of the antenna 100, and an outer conductor (not shown) is connected directly to the ground plates GND1-GND6.

In the case of a related art antenna, an open stub is employed to the feed unit of the antenna to create impedance matching with respect to frequencies in a specific range. According to an embodiment of the invention, however, the slot is formed by etching the top end of the feed line, so any additional element like the open stub is not required.

Figure 9:
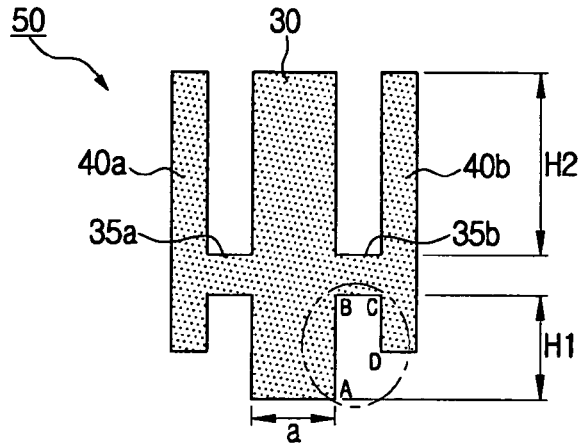
FIG. 9 is a plan view of a radiating element of a miniaturized ultra-wideband microstrip antenna according to an aspect of the present invention.
Figure 9:
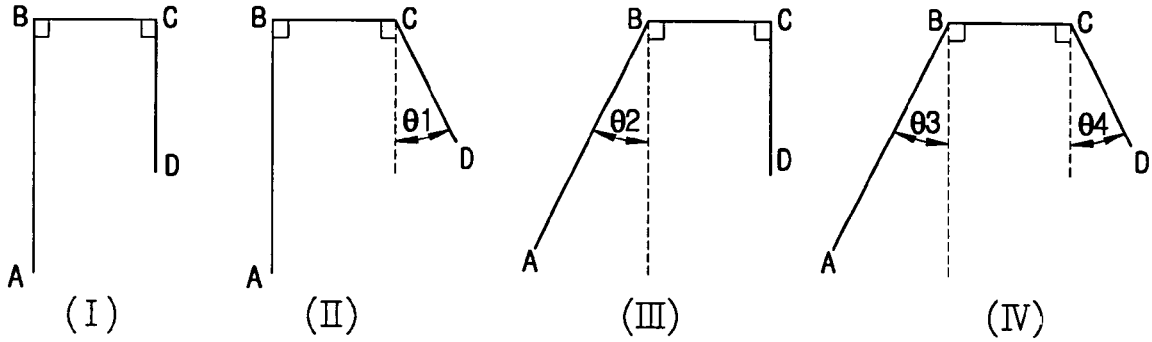

FIG. 9 is a plan view of a radiating element of the miniaturized ultra-wideband microstrip antenna according to an aspect of the present invention.

As shown in FIG. 9, the radiating element 50 includes a main radiating element 30, and a plurality of sub-radiating elements 40*a*, 40*b*. The upper ends of the main radiating element 30 and the sub-radiating elements 40*a*, 40*b* have a rectangular shape, respectively. Although the lower ends of the main radiating element 30 and the sub-radiating elements 40*a* and 40*b* in FIG. 9 have a rectangular shape, they are illustrative only. In effect, the lower ends of the radiating elements can have various shapes including a taper or inverted triangle.

The main element 30 and the sub-radiating elements 40*a*, 40*b* are electrically connected to each other through connection plates 35*a*, 35*b*. The connection plates 35*a*, 35*b* can be formed on the upper end, center, or lower end of the main and sub-radiating elements 30, 35*a*, and 35*b*. If the radiating elements are indirectly connected to each other through a medium like an electromagnetic coupling, the main radiating element 30 and the sub-radiating elements 40*a*, 40*b* are naturally spaced apart. If this is the case, the connection plates 35*a*, 35*b* are not necessary.

The main radiating element 30 and the sub-radiating elements 40*a*, 40*b* are made by etching one conductor plate and forming a slot therebetween. This type of structure is called a 'notch' structure.

For convenience in explaining the notch structure, the lower-right end of the main radiating element 30, the right side connection plate 35*b*, and the lower-left end of the right side sub-radiating element 40*b* are illustrated.

As shown in FIG. 9, the notch structures come in various types. For example, (I) illustrates a structure where sides AB, BC, and CD meet at right angles to each other; and (II) illustrates a structure where sides AB and BC meet at right angles, while sides BC and CD form a $(90°+\theta_1)$ angle.

(III) illustrates a structure where sides BC and CD are perpendicular to each other, and sides BC and AB form a $(90°+\theta_2)$ angle; and (IV) illustrates a structure where sides AB and BC form a $(90°+\theta_3)$ angle, and sides BC and CD form a $(90°+\theta_4)$ angle, wherein $\theta_1$, $\theta_2$, $\theta_3$, and $\theta_4$ are arbitrary angles.

The length of side AB, namely H1, is a controlling factor of the input impedance of the antenna. In other words, if the length of side AB (or H1) is increased, the wideband characteristics of the antenna are limited and low frequency radiation patterns become distorted. Meanwhile, if H2 is increased, high frequency radiation patterns are improved gradually to a certain limit, but when H2 exceeds a predetermined length, the radiation patterns are distorted again.

Figure 10:
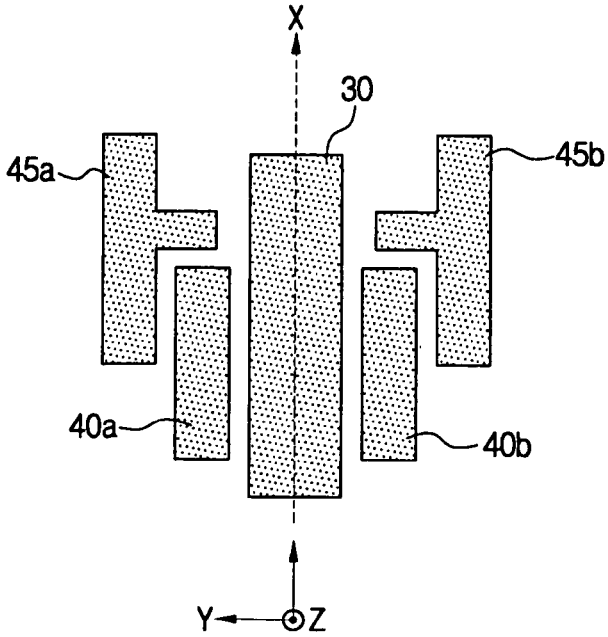
FIG. 10 illustrates another embodiment of FIG. 9.

FIG. 10 illustrates another embodiment of FIG. 9.

Referring to FIG. 10, the main radiating element 30 and the sub-radiating elements 40*a*, 40*b* can be spaced apart from each other. In this case, the main radiating element 30 and the sub-radiating elements 40*a*, 40*b* are indirectly connected to each other through an electromagnetic coupling.

As shown in FIG. 10, the main radiating element 30 is located on the x-axis, and the sub-radiating elements 40*a*, 40*b* are symmetric with respect to the xz plane. It should be noticed that more than two sub-radiating elements could be symmetrically arranged with respect to the xz plane.

Also, additional sub-radiating elements 45*a*, 45*b* can be formed on the dielectric substrate 10. For example, in FIG. 10, the additional sub-radiating elements 45*a*, 45*b* are indirectly connected to the main radiating element 30 or the sub-radiating elements 40*a*, 40*b*, respectively, being spaced apart from each. Alternatively however, the additional sub-radiating elements 45*a*, 45*b* can be connected directly to the main radiating element 30 and the sub-radiating elements 40*a*, 40*b* through connection plates (not shown). Also, the main radiating element 30 and the sub-radiating elements 40*a*, 40*b* and the additional sub-radiating elements 45*a*, 45*b* can be all connected directly to each other through connection plates.

Besides the shapes shown in FIG. 10, the additional sub-radiating elements 45*a*, 45*b* come in various shapes, e.g., rectangular shapes, cross shapes, and 'T' shapes.

Figure 11:
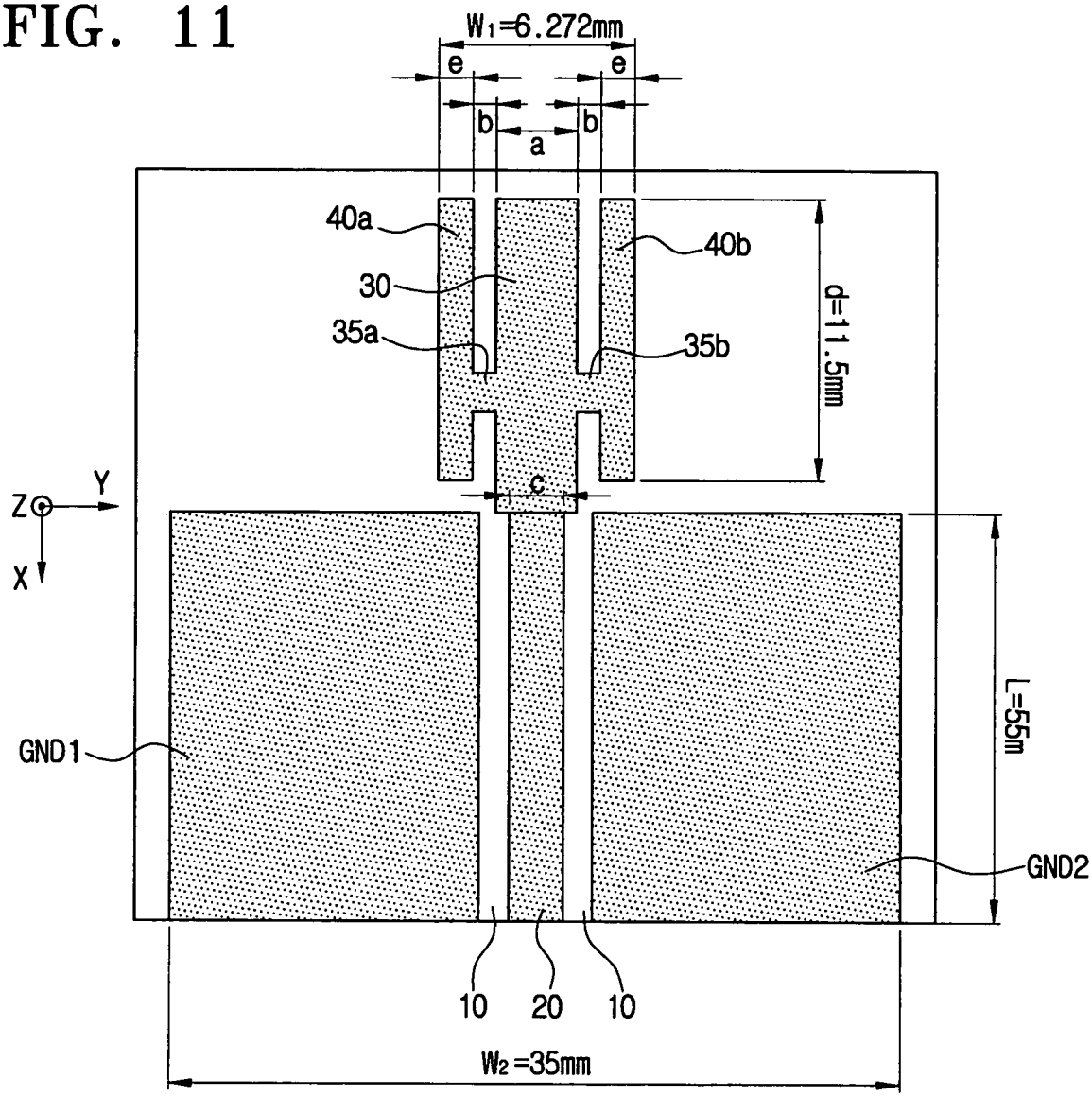
FIG. 11 is a plan view of FIG. 6.

FIG. 11 is a plan view of FIG. 6. Referring to FIG. 11, the upper end of the main radiating element 30 has a rectangular shape, and the short side of the bottom of the main radiating element 30 is directly connected with the short side of the top of the feed line 20. In particular, FIG. 11 illustrates the radiating element, in which the length of the short side of the bottom of the main radiating element 30, a, is longer than the length of the short side of the top of the feed line 20, c. Preferably, but not necessarily, the length of the long side, L, of the feed line 20 is about 55 mm.

In an embodiment of the invention, the length of the short side of the bottom of the main radiating element 30, a, is longer than or equal to the length of the short side of the top of the feed line 20, c. That is, $a \geqq c$. Even though FIG. 11 illustrates a rectangular-shaped lower end for the main radiating element 30, a taper- or inverted triangle-shaped lower end is also possible.

The shape of the upper ends of the sub-radiating elements 40*a*, 40*b* can be arbitrary, but preferably it has a rectangular shape in the interest of reducing the size of the antenna 100. Also, the shape of the lower ends of the sub-radiating elements 40*a*, 40*b* does not have to be limited to the rectangular shape, but can be diverse like a taper or inverted triangle shape.

If the sub-radiating elements 40*a*, 40*b* are connected directly to the main radiating element 30, the connection plates 35*a*, 35*b* preferably but not necessarily, have taper shapes. That is, the width of the sub-radiating elements 40*a*, 40*b* located lower than the connection plates 35*a*, 35*b* is gradually reduced. The length of the long side of the sub-radiating elements 40*a*, 40*b* is smaller than or equal to the length of the long side, d, of the main radiating element 30. Preferably, but not necessarily, the length of the long side of the main radiating element 30 is about 11.5 mm.

The width $W_1$ of the antenna, the sum of the length of the short side, a, of the main radiating element 30, the length, b, of the connection plate, and the length of the short side, e, of the sub-radiating element. As shown in FIG. 11, $W_1 = a + 2b + 2e \approx 6.272$ mm.

The ground plates GND are composed of broad planar conductors. The shape of the ground plates GND varies, depending on the feed structure being used. In other words, in case of the microstrip feeding, the ground plate GND6 is formed by coating the bottom of the dielectric substrate with a conductor plate.

In case of the CPW fed microstrip antenna, the first and second ground plates GND1, GND2 are disposed on the dielectric substrate, each being spaced apart in both sides of the feed line. Meanwhile, in case of the GCPW fed microstrip antenna, the fifth ground plate GND5 is formed at the bottom of the dielectric substrate, and the third and fourth ground plates GND3, GND4, similar to the ones in the CPW fed microstrip antenna, are disposed on the dielectric substrate, each being spaced part in both sides of the feed line.

Preferably, but not necessary, the width $W_2$ of the ground plates GND1-GND6 is approximately 35 mm. However, the size of the ground plates GND1-GND6 can be varied according to what kind of the miniaturized ultra-wideband microstrip antenna 100 is applied.

The following will now explain the operational principles of the present invention.

Electromagnetic energy transmitted through the microstrip fed antenna, the CPW fed antenna, or the GCPW fed antenna is transmitted in TEM or QuasiTEM mode to the radiating element 50. This transmitted energy is expressed as the current flow at the surface of the radiating element 50.

Figure 12A:
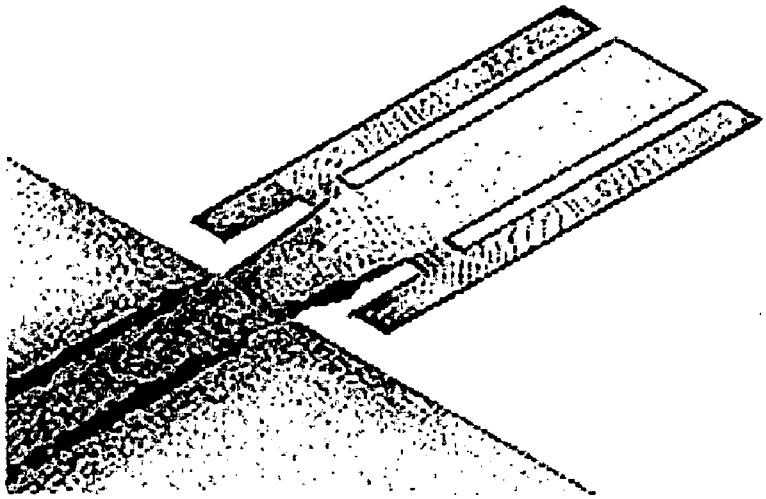
FIGS. 12A and 12B illustrate current distribution of a miniaturized ultra-wideband microstrip antenna according to an aspect of the present invention, where the amplitude of the antenna is 1 and the phase of the antenna is 0 degree, respectively.
Figure 12B:
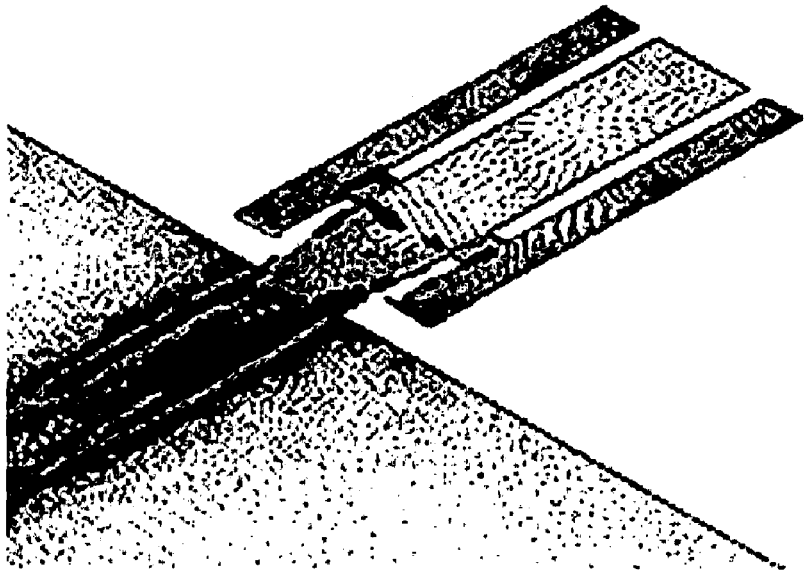

FIGS. 12A and 12B illustrate current distribution of the miniaturized ultra-wideband microstrip antenna according to an aspect of the present invention, where the amplitude of the antenna is 1 and the phase of the antenna is 0 degree, respectively More specifically, FIG. 12A illustrates the current distribution when the center frequency is 5 GHz. Referring to FIG. 12A, the current is mainly induced around the lower end of the main radiating element 30. FIG. 12B illustrates the current distribution when the center frequency is 10 GHz. Referring to FIG. 12B, the current is induced even to a certain area of the sub-radiating elements 40*a*, 40*b* through the connection plates 35*a*, 35*b*.

Then, an electromagnetic field is generated perpendicular to the current flow, and as a result, spherical electromagnetic waves are radiated from the antenna.

Figure 13A:
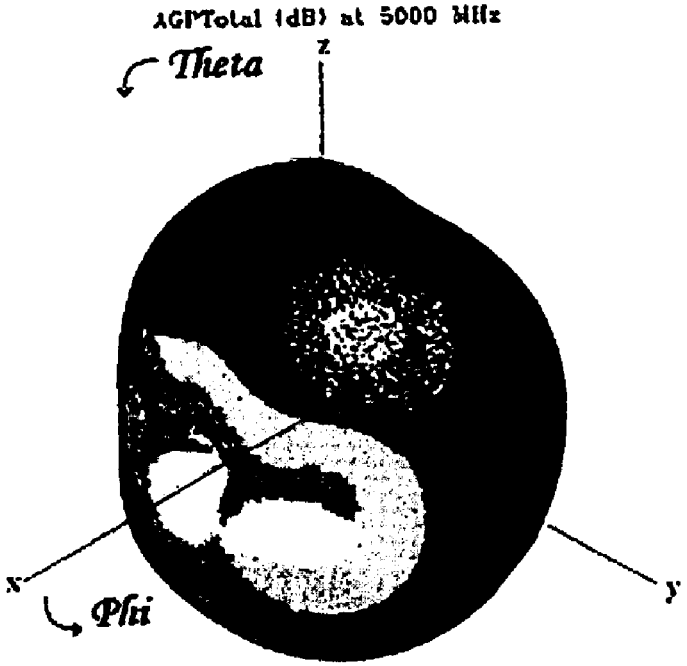
FIGS. 13A and 13B illustrate three-dimensional diagram illustrating a radiation pattern of a miniaturized ultra-wideband microstrip antenna according to an aspect of the present invention plotted on spherical coordinates.
Figure 13B:
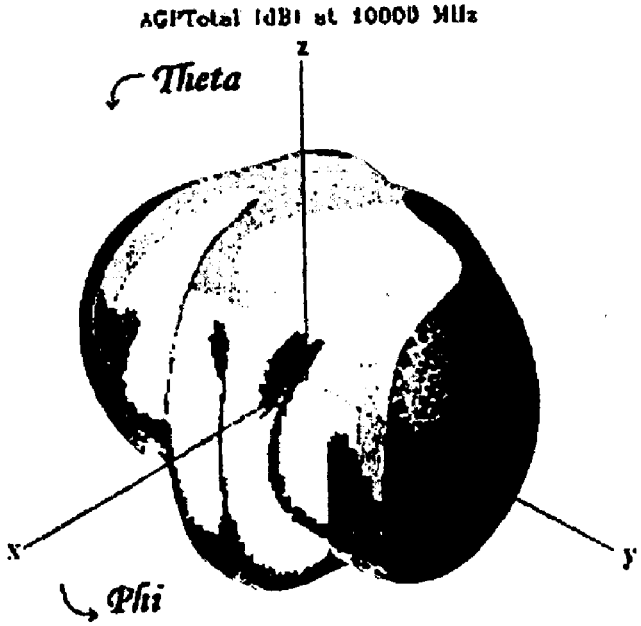

FIGS. 13A and 13B are three-dimensional diagrams illustrating a radiation pattern of the miniaturized ultra-wideband microstrip antenna according to an aspect of the present invention plotted on spherical coordinates. More specifically, FIG. 13A illustrates the radiation pattern in a spherical shape, wherein the pattern is calculated at a central frequency of 5 GHz. FIG. 13B illustrates the radiation pattern in an elliptical shape, wherein the pattern is calculated at a central frequency of 10 GHz.

Figure 14:
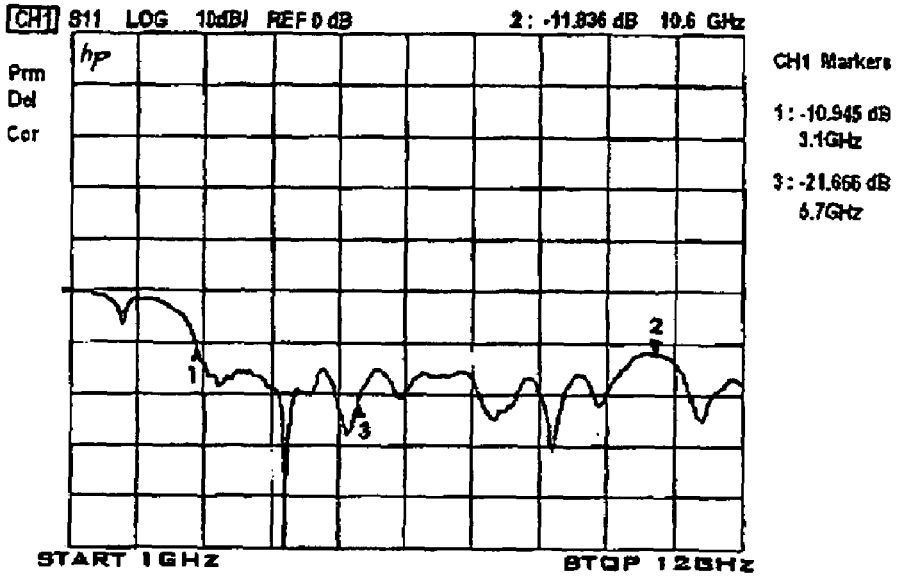
FIG. 14 is a graph illustrating an insertion loss (S11) of a miniaturized ultra-wideband microstrip antenna according to an aspect of the present invention.

FIG. 14 is a graph illustrating an insertion loss S11 of the miniaturized ultra-wideband microstrip antenna according to an aspect of the present invention. As shown in FIG. 14, the insertion loss S11 in a frequency range extending from 3.0 GHz to 12 GHz is less than 10 dB, so that the present invention antenna satisfies UWB's range.

Figure 15:
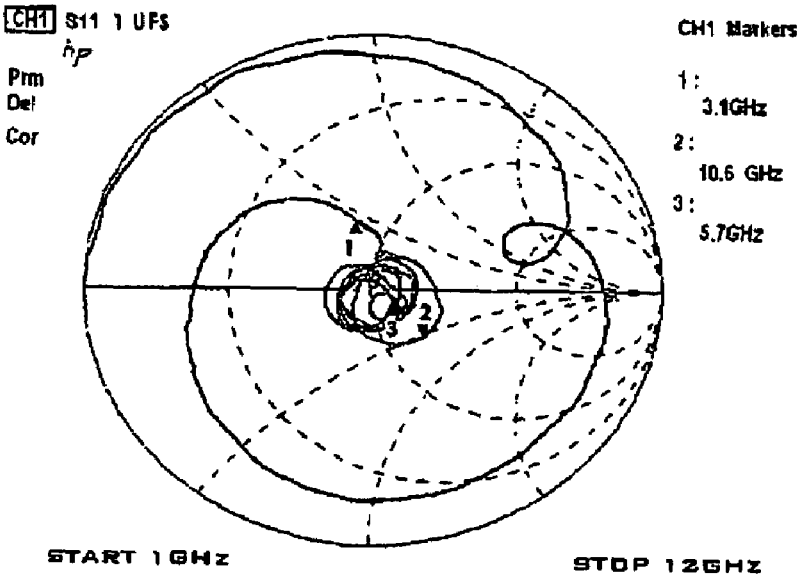
FIG. 15 illustrates an insertion loss (S11) of FIG. 14 plotted on a smith chart.

FIG. 15 illustrates the insertion loss (S11) of FIG. 14 plotted on a smith chart. The chart shows a frequency trajectory when standard input power is applied, and amplitude and phase of the antenna with respect to different frequencies.

Figure 16:
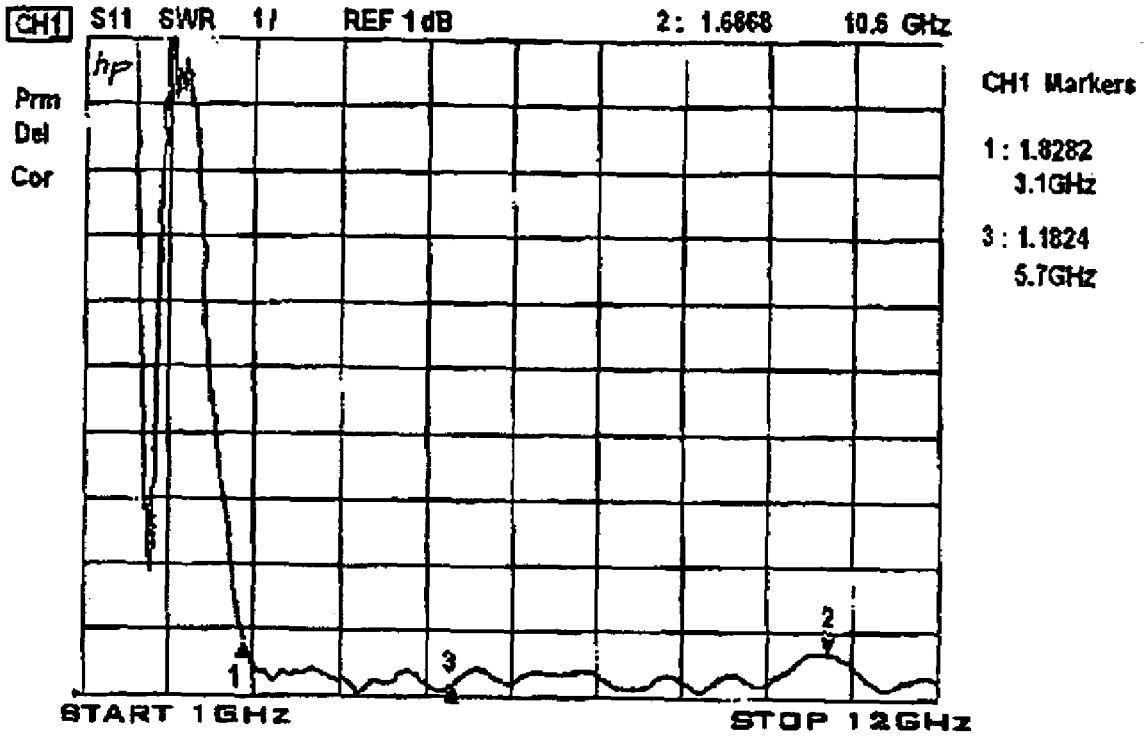
FIG. 16 is a graph illustrating VSWR of a miniaturized ultra-wideband microstrip antenna according to an aspect of the present invention.

FIG. 16 is a graph illustrating VSWR of the miniaturized ultra-wideband microstrip antenna according to an aspect of the present invention. As shown in FIG. 16, the VSWR in a frequency range from 3.0 GHz to 12 GHz is less than 2.0, that is the present invention antenna satisfies UWB's range.

In case of constructing an antenna having additional sub-radiating elements according to an embodiment of the invention, the VSWR in a frequency range from 3.0 GHz to 18 GHz can be reduced to lower than 2.0. Thus, excellent wideband characteristics can be obtained.

Therefore, it is possible to construct a miniaturized ultra-wideband microstrip antenna having no reflection in a desired frequency range.

In conclusion, according to an aspect of the present invention, it is possible to construct a miniaturized, ultra-light antenna combined with the dielectric substrate. Also, applying the PCB process, the microstrip antenna can be more easily and cost-effectively manufactured.

Also, according to an aspect of the present invention, the antenna includes additional sub-radiating elements besides the main radiating element, whereby multi-radiation in the UWB range can be realized.

According to an aspect of the present invention, the antenna has an improved notch structure for the radiating element. Thus, it is easy to adjust a frequency range and to control multi-band and band stop characteristics.

According to another aspect of the present invention, the current distribution can be changed in dependence of changes of radiation frequency, and through these changes, the radiation area can be changed also. In this manner, radiation patterns in wideband can be improved.

Lastly, the microstrip antenna of the present invention can be advantageously used for high-speed radio communication antennas employing electromagnetic impulses. This is because in case of the present invention antenna, time delay in transmitting/receiving impulses in different frequencies is insignificant compared to existing antennas and thus, pulses are hardly distorted.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A miniaturized ultra-wideband microstrip antenna, comprising:

a dielectric substrate;

a feed line disposed on the dielectric substrate, and supplying electromagnetic energy supplied from an external power source;

a main radiating element radiating the electromagnetic energy inputted by the feed line;

at least one sub-radiating element disposed in proximity to the main radiating element for multi-radiation; and at least one connection plate connecting the at least one sub-radiating element to the main radiating element, wherein the feed line comprises at least one slot of a predetermined size formed by an etching process, wherein one sub-radiating element is connected to the main radiating element by one connection plate only, and the main radiating element and the sub-radiating element have a same length.

2. The antenna according to claim 1, wherein an upper end of the main radiating element has a rectangular shape, the sub-radiating elements are symmetrically arranged with respect to the main radiating element, and an upper end of each sub-radiating element has a rectangular shape reducing the size of the antenna.

3. The antenna according to claim 2, wherein a length of a long side of the sub-radiating element is smaller than or equal to a length of a long side of the main radiating element.

4. The antenna according to claim 1, wherein one lower side of the main radiating element and the connection plate form a 90° angle, and the connection plate and one lower side of the sub-radiating element form a 90° angle.

5. The antenna according to claim 1, wherein the main radiating element and the sub-radiating elements are disposed on the same planar surface.

6. The antenna according to claim 1, wherein the main radiating element and the sub-radiating elements are disposed on a different planar surface.

7. The antenna according to claim 1, wherein the main radiating element and the sub-radiating elements are indirectly connected to each other through an electromagnetic coupling, and are spaced apart by a predetermined distance.

8. The antenna according to claim 1, wherein the dielectric substrate is an epoxy laminate (FR−4) substrate having a relative dielectric constant ($\epsilon_r$) of approximately 4.4.

9. The antenna according to claim 1, wherein a length of a long side of the main radiating element is approximately 11.5 mm.

10. The antenna according to claim 1, wherein a length of a long side of the feed line is approximately 55 mm.

11. The antenna according to claim 1, wherein a sum of a length of a short side of the main radiating element, a length of the connection plate, and a length of a short side of the sub-radiating element is approximately 6.272 mm.

12. The antenna according to claim 1, wherein the connection plates are formed on an upper end, center, or lower end of the main and sub-radiating elements.

13. The antenna according to claim 1, further comprising:

a plurality of ground plates disposed on a top of the dielectric substrate, each being symmetrically spaced apart by a predetermined distance with respect to the feed line.

14. The antenna according to claim 13, further comprising:

a ground plate having a predetermined size disposed at a bottom of the dielectric substrate.

15. The antenna according to claim 1, further comprising:

a ground plate having a predetermined size to be disposed at a bottom of the dielectric substrate.

16. The antenna according to claim 1, wherein an insertion loss in a frequency range from 3.0 GHz to 12 GHz is less than 10 dB.

17. The antenna according to claim 1, wherein VSWR in a frequency range from 3.0 GHz to 12 GHz is less than 2.0.

18. The antenna according to claim 1, wherein if center frequency is 5 GHz, current is induced to a lower end of the main radiating element.

19. The antenna according to claim 1, wherein if center frequency is 5 GHz, current is induced to the main radiating element and a part of the sub-radiating element.

20. The antenna according to claim 1, wherein if center frequency is 10 GHz, current is induced to the main radiating element, the connection plate, and a part of the sub-radiating element.

21. The antenna according to claim 1, further comprising:

at least one additional sub-radiating element disposed at a predetermined position improving wideband characteristics of the antenna.

22. The antenna according to claim 21, wherein voltage standing wave ratio (VSWR) in a frequency range from 3.0 GHz to 18 GHz is less than 2.0.

23. The antenna according to claim 21, further comprising:

a plurality of connection plates electrically connecting the main radiating element, the sub-radiating elements, and the additional sub-radiating elements to each other.

24. The antenna according to claim 21, further comprising:

at least one connection plate electrically connecting the main radiating element to the additional sub-radiating elements.

25. The antenna according to claim 21, further comprising:

at least one connection plate electrically connecting the sub-radiating elements to the additional sub-radiating elements.

26. The antenna according to claim 21, wherein the additional sub-radiating elements are disposed on a same planar surface as the main radiating element or as the sub-radiating elements.

27. The antenna according to claim 21, wherein the additional sub-radiating elements are disposed on a same planar surface as the main radiating element and the sub-radiating elements.

28. The antenna according to claim 1, further comprising:

at least one additional sub-radiating element disposed at a predetermined position improving wideband characteristics of the antenna.

29. The antenna according to claim 28, wherein the sub-radiating elements and the additional sub-radiating elements are indirectly connected to each other through electromagnetic coupling, and are spaced apart by a predetermined distance.

30. The antenna according to claim 28, further comprising:

at least another connection plate electrically connecting the sub-radiating elements to the additional sub-radiating elements.

31. The antenna according to claim 28, wherein the additional sub-radiating elements are disposed on a same planar surface as the main radiating element or as the sub-radiating elements.

32. The antenna according to claim 28, wherein the additional sub-radiating elements are disposed on a same planar surface as the main radiating element and the sub-radiating elements.

33. The antenna according to claim 1, wherein the main radiating element and the sub-radiating elements are connected to each other through electromagnetic coupling.

34. The antenna according to claim 1, wherein the feed line is connected to a coaxial cable, and a center conductor of the coaxial cable is connected to a lower end of the main radiating element of the antenna, and an outer conductor is connected to a ground plate.

35. The antenna according to claim 1, wherein the main radiating element, the connection plates, and the sub-radiating elements are conductors.

36. The antenna according to claim 1, wherein the main radiating element, the connection plates, and the sub-radiating elements are plated with tin.

37. The antenna according to claim 1, wherein the main radiating element and the sub-radiating elements are connected to each other via hole.

38. The antenna according to claim 1, wherein a PCB process is applied to manufacture the antenna.

39. A miniaturized ultra-wideband microstrip antenna, comprising:

a main radiating element radiating electromagnetic energy inputted by a feed line;

at least one sub-radiating element disposed proximate to the main radiating element; and at least one connection plate connecting the main radiating element to at least one sub-radiating element, wherein one lower side of the main radiating element and the connection plate form a 90° angle, and the connection plate and one lower side of the sub-radiating element form a $(90°+\theta_1)$ angle, where $\theta_1$ is a predetermined angle.

40. A miniaturized ultra-wideband microstrip antenna, comprising:

a main radiating element radiating electromagnetic energy inputted by a feed line;

at least one sub-radiating element disposed proximate to the main radiating element; and at least one connection plate connecting the main radiating element to at least one sub-radiating element, wherein one lower side of the main radiating element and the connection plate form a $(90°+\theta_2)$ angle (where $\theta_2$ is a predetermined angle), and the connection plate and one lower side of the sub-radiating element form a 90° angle.

41. A miniaturized ultra-wideband microstrip antenna, comprising:

a main radiating element radiating electromagnetic energy inputted by a feed line;

at least one sub-radiating element disposed proximate to the main radiating element; and at least one connection plate connecting the main radiating element to at least one sub-radiating element, wherein one lower side of the main radiating element and the connection plate form a $(90°+\theta_3)$ angle, and the connection plate and one lower side of the sub-radiating element form a $(90°+\theta_4)$ angle, where, $\theta_3$ and $\Theta_4$ are predetermined angles.

42. A miniaturized antenna, comprising:

a substrate having first and second sides;

a feed line disposed on the first side of the substrate;

a radiating element connected to the feed line;

at least one sub-radiating element disposed in proximity to the radiating element, at least one connection plate directly connecting the radiating element to the at least one sub-radiating element, wherein the feed line comprises at least one slot of a predetermined size formed by an etching process, and wherein the radiating element and the sub-radiating element have a same length.

43. The antenna according to claim 42, wherein at least one ground plate is disposed in close proximity to the feed line.

44. The antenna according to claim 42, wherein a ground plate is disposed on the second side of the substrate.

45. An antenna, comprising:

a radiating element connected to a feed line;

at least one sub-radiating element proximate to the radiating element, at least one connection plate connecting the radiating element to the at least one sub-radiating element, wherein the radiating element and the sub-radiating element have a same length, and wherein the at least one sub-radiating element has first and second portions respectively extending in first and second directions from the connection plate.

* * * * *